US005190851A

United States Patent [19]

Chari et al.

[11] Patent Number: 5,190,851

[45] Date of Patent: Mar. 2, 1993

[54] COLOR PHOTOGRAPHIC ELEMENT

[75] Inventors: Krishnan Chari, Rochester; John T. Keech, Penfield; John F. Sawyer, Fairport; Jeffrey W. Schmoeger; Paul L. Zengerle, both of Rochester, all of N.Y.

[73] Assignee: Eastman Kodak Company, Rochester, N.Y.

[21] Appl. No.: 631,607

[22] Filed: Dec. 21, 1990

[51] Int. Cl.[5] ..... G03C 1/46

[52] U.S. Cl. ..... 430/505; 430/506; 430/546; 430/567; 430/568

[58] Field of Search ..... 430/505, 506, 546, 567, 430/568

[56] References Cited

U.S. PATENT DOCUMENTS

| | | | |
|---|---|---|---|
| 3,843,369 | 10/1974 | Kumai et al. | 430/506 |
| 4,184,876 | 1/1980 | Eeles et al. | 430/505 |
| 4,186,011 | 1/1980 | Lohmann et al. | 430/505 |
| 4,564,587 | 1/1986 | Watanabe et al. | 430/505 |
| 4,704,350 | 11/1987 | Morigaki et al. | 430/546 |
| 4,770,987 | 10/1987 | Takahashi et al. | 430/546 |
| 4,780,399 | 10/1988 | Urata | 430/506 |
| 4,857,449 | 8/1989 | Ogawa et al. | 430/546 |
| 4,946,765 | 7/1990 | Hahm | 430/504 |

FOREIGN PATENT DOCUMENTS

| | | |
|---|---|---|
| 818687 | 12/1957 | United Kingdom . |
| 923045 | 7/1961 | United Kingdom . |

*Primary Examiner*—Charles L. Bowers, Jr.
*Assistant Examiner*—Janet C. Baxter
*Attorney, Agent, or Firm*—Edith A. Rice

[57] ABSTRACT

A color photographic silver halide negative working duplicating element comprising a support having thereon at least one red-sensitive photographic silver halide emulsion layer comprising at least one cyan image-dye forming coupler; at least one green-sensitive photographic silver halide emulsion layer comprising at least one magenta image-dye forming coupler; and, at least one blue-sensitive photographic silver halide emulsion layer comprising at least one yellow image-dye forming coupler, provides improved images when (a) at least one of the layers comprises a unit of at least two layers including a first layer and a second layer, the first layer having a higher photosensitivity than the second layers and being farther from the support than the second layers; (b) the first layers contain an image-dye forming coupler in an amount insufficient to react with all the oxidized developer formed during development after maximum exposure; (c) the image-dye forming couplers of the first layers being in a dispersion having a mean particle size of less than 0.14 micron; and, (d) the silver halide grains of the first layers having a mean grain volume less than 0.015 cubic micron. Such a photographic element is especially useful in motion picture film duplication providing reduction in granularity of the image.

8 Claims, No Drawings

COLOR PHOTOGRAPHIC ELEMENT

BACKGROUND OF THE INVENTION

1. Field of the Invention

This invention relates to color photographic elements and more particularly to improved color photographic elements having a significant reduction in granularity.

2. Description of Related Art

Color photographic silver halide elements are well known in the photographic art. Such elements are described in, for example, Research Disclosure, December 1989, Item No. 308119 and the references listed in this publication. (Research Disclosure is published by Kenneth Mason Publications Ltd., Dudley Annex, 12a North Street, Emsworth, Hampshire PO10 7 DQ, England.)

Silver halide color photographic materials described in U.K. Specification No. 818,687 have improved speed characterized in that the sensitive layer nearest to the support is a composite layer comprising two separate coatings of silver halide emulsions containing non-diffusible color formers which on color development yield images of the same or substantially the same color, the emulsions being sensitized to light of the same waveband.

U.K. Patent Specification 923,045 discloses a color photographic multilayer material having at least two light-sensitive silver halide emulsion layers. The layers contain colorless color couplers resistant to diffusion and capable of forming after imagewise exposure upon development with a color developer a colored image of substantially the same color, the two layers being sensitized to the same region of the same region of the visible spectrum but having different sensitivity. The more sensitive of these layers produces a color image of lower color density upon development than the less sensitive layer wherein the color coupler concentration in the more sensitive layer is 10–50 percent of the color coupler concentration in the less sensitive layer.

U.S. Pat. No. 3,843,369 discloses a multi-layer color photographic light-sensitive material, prepared using cyan-, magenta- and yellow-forming emulsion layers, each layer being divided into at least three emulsion layers sensitive to the same spectral region of visible light. Improved granularity of the dye image formed in each of the emulsion layers and also that of the overall image is obtained.

U.S. Pat. No. 4,184,876 discloses a photographic silver halide multi-layer color material having at least one blue-sensitive silver halide layer, at least two green-sensitive silver halide emulsion layers having different speeds and at least two red-sensitive silver halide emulsion layers having different speeds wherein the faster green-sensitive emulsion layer and faster red-sensitive emulsion layers are located further from the support then the slower green- and red-sensitive layers. The faster red- and green-sensitive layers can be relatively "starved" with respect to their color coupler contents in order to improve the granularity of these layers.

U.S. Pat. No. 4,186,011 discloses a color photographic material containing several differently sensitized silver halide layers, each of the three spectral regions having at least one silver halide emulsion layer, at least one of the spectral regions having at least three layers, one of which is free of silver halide but contains color coupler.

U.S. Pat. No. 4,564,587 discloses a light-sensitive silver halide color photographic material having at least one light-sensitive layer constituted of a plurality of silver halide emulsion layers of the same color sensitivity, the low sensitivity silver halide emulsion being closest to the support, the high sensitivity silver halide emulsion being farthest from the support and the medium sensitive layer being in the middle, wherein a non-sensitive intermediate is coated between the low and medium sensitive silver halide emulsion layers.

U.S. Pat. No. 4,704,350 relates to a silver halide color photographic material containing a pyrazoloazole magenta coupler to prevent color stains during development. Various multi-layer structures are disclosed.

U.S. Pat. No. 4,770,987 relates to a silver halide color photographic material at least one silver halide emulsion layer having dispersed therein lipophilic fine particles containing an image dye forming lipophilic coupler and further containing a lipophilic compound having a water-solubility of not more than 1% by weight at 25° C. Various multi-layer structures are disclosed.

These references illustrate the development of color photographic elements and the movement toward more light sensitive photographic materials. Such materials have relied upon larger silver halide grain size to provide increased light sensitivity. The larger grain size of silver halide provides a problem. This problem is the increase in granularity, especially increased RMS granularity, that is observed in the photographic elements. Attempts to solve this problem have included use of multiple layers, such as described in the above references, and coupler starvation, such as defined in U.S. Pat. No. 4,946,765 (column 2).

Color photographic silver halide elements typically contain a layer unit sensitive to the blue region of the electromagnetic spectrum, a layer unit sensitive to the green region of the electromagnetic spectrum, and a unit sensitive to the red region of the electromagnetic spectrum. Each of the layer units can comprise one, two, three or more layers. At least one of the layer units typically comprises a layer that is the most light sensitive layer of the particular unit and designated the "fast layer" (FL); a layer that is the least light sensitive layer of the particular unit and designated the "slow layer" (SL); and, optionally a layer that has a light sensitivity between the light sensitivities of the fast layer and the slow layer, designated the "mid layer" (ML). For a given layer unit, the concentration of dye-forming coupler in each of the fast layer and the mid layer are typically within the range of 5 to 25% of the concentration of dye-forming coupler in the slow layer. This typical use of a limited concentration of dye-forming coupler in the fast layer and the mid layer enables coupler starvation as known in the photographic art. This use of coupler starvation also enables improvement of granularity of the photographic element at moderate and/or high exposure levels.

Until now, the color negative photographic silver halide elements that used coupler starvation were in a light sensitivity range that required the use of silver halide emulsion grains that were of such a size that the RMS granularity was controlled by the emulsion grain size and coupler availability. The normal coupler dispersion particle size did not limit the granularity improvement in such materials. However, a problem was encountered with photographic silver halide elements that were designed to be color photographic silver halide negative working duplicating elements, for example color motion picture duplicating films. The problem encountered was that the desired degree improvement in granularity could not be provided by coupler starvation alone and no answer to the problem was clear from the prior art.

This problem is particularly bothersome in the motion picture industry wherein multiple numbers of duplicates are prepared for distribution from a negative working duplicating element especially prepared for this purpose.

A continuing need has existed for a color photographic silver halide negative working duplicating element and particularly a negative working duplicating element for preparing positive motion picture prints having extremely low granularity.

SUMMARY OF THE INVENTION

The answer to this problem was found to be a color photographic silver halide element comprising a support having thereon at least one red-sensitive photographic silver halide emulsion layer comprising at least one cyan image-dye forming coupler; at least one green-sensitive photographic silver halide emulsion layer comprising at least one magenta image-dye forming coupler and at least one blue-sensitive photographic silver halide emulsion layer comprising at least one yellow image-dye forming coupler, wherein (a) at least one of the layers, preferably at least one of the red and green sensitive layers, comprises a unit of at least two layers including a first layer and a second layer, the first layer has a higher sensitivity than the second layer and is farther from the support than the second layer;

(b) the first layers contains an image-dye forming coupler in an amount insufficient to react with all of the oxidized developer formed during development after maximum exposure;

(c) the image-dye forming coupler in the first layers is in a dispersion having a mean particle size of less than 0.14 micron; and (d) the silver halide grains of the first layers have a mean grain volume less than 0.015 cubic micron.

The described color photographic silver halide negative working duplicating element can be any such element used for duplicating purposes, typically a motion picture duplicating film. The described components are preferably used in a photographic silver halide negative working duplicating element as described in U.S. patent application Ser. No. 631,541, filed on even date herewith, entitled "Color Photographic Silver Halide Duplicating Element and Process" of J. R. Sawyer and D. E. Fenton, the disclosure of which is incorporated herein by reference.

DESCRIPTION OF PREFERRED EMBODIMENTS

The invention contemplates a multi-layer colored photographic silver halide element having blue, green and red sensitive layers where at least one of the layers are divided into several layers of different sensitivity having the requirements set forth above. Where there are only two layers of either red or green, the higher sensitive layer has the requirements (a) through (d) set forth above. Where there are more than two layers, for example, where the red sensitive layer is a unit of three layers of a high red sensitive layer, a medium red sensitive layer and a low red sensitive layer or the green sensitive layer is a unit of three layers of a high green sensitive layer, a medium green sensitive layer and a low green sensitive layer either the high sensitive or medium sensitive layer or both the high and medium sensitive layers will have the requirements (a) through (d) set forth above.

In a preferred embodiment, the red and green layers are each divided into high, medium and low sensitive layers wherein both the high and medium layers meet the requirements indicated. That is, the green sensitive layers containing magenta image-dye forming couplers and the red-sensitive layers containing cyan image-dye forming couplers are each a composite layer or unit made up of three layers, a low sensitive layer, a medium sensitive layer and a high sensitive layer each of which is sensitive to light in the same region of the visible spectrum. The high green sensitive layer and the medium green sensitive layer are further from the support than the lower green sensitive layer and a high red sensitive layer and the medium red sensitive layer further from the support than the low red sensitive layer, the image-dye forming couplers of each of the high and medium sensitive layers are present in an amount insufficient to react with all of the oxidized developer formed during the development after maximum exposure, the coupler dispersion particles have a mean size less than 0.14 micron, and the silver halide grains of the high and medium sensitive layers have a mean grain volume of less than 0.015 cubic micron.

As indicated above, in the prior art color photographic materials the silver halide grains generally employed in the faster or higher sensitive layers of the composite layer, each of which is sensitive to light in the same region of the spectrum, i.e., the faster green, red or blue layers, are much larger in physical size, that is, they have a larger mean diameter, than those employed in the medium speed or sensitive layers and the AgX grains employed in the medium speed layers have a mean particle size greater than that employed in the low or lower speed layers. This is true because as the speed of the layer is increased, the size of the particles also is increased to obtain the desired result. In accordance with this invention, the high or medium layers, differ substantially from the prior art with respect to the silver halide grains. In a preferred embodiment of the invention the prime purpose of the photographic element is to serve as a negative working duplicating film in the production of positive motion picture films for distribution and projection in motion picture theaters. In such films low graininess is the goal and not relative speed of the film. The silver halide grains in these layers must therefore be of a mean volume size that is significantly smaller than is typically useful in other photographic silver halide elements.

It may be desirable that the blue-sensitive layer comprising at least one yellow image-dye forming coupler also comprise a unit of at least two layers of a high blue-sensitive layer and a low blue-sensitive layer or a unit of a high, medium and low blue sensitive layers. It may also be desired that either the high or medium blue-sensitive layer or both the high and medium blue-sensitive layers of the unit meet the requirement (a) through (d) set forth above.

The photographic silver halide emulsions in each of the layers are comprised of very fine grain photographic silver halides, preferably silver bromoiodide. The emulsions can include silver halide grains of any conventional shape provided that the shape and size selected enable the duplication results as described. The emulsions preferably comprise silver bromoiodide grains that are cubic grains and/or tabular grains. The tabular grain photographic silver halide emulsions can be prepared by any procedure known in the photographic art for preparation of such grains. The tabular grain photographic silver halide can be any of the tabular grain photographic silver halides described in, for example, U.S. Pat. Nos. 4,434,226; 4,414,310; 4,399,215; 4,433,048; 4,386,156; 4,504,570; 4,400,463; 4,414,306; 4,435,501; 4,643,966; 4,672,027 and 4,693,964 provided that the grains are of the required volume. The silver halide grains can be either monodisperse or polydisperse as precipitated. The grain size distribution of the emulsions can be controlled using techniques known in the photographic art.

Sensitizing compounds, such as compounds of copper, thallium, lead, bismuth, cadmium, and group VIII noble metals, can be present during the precipitation of the silver halide emulsions.

The silver halide emulsions can be surface sensitized by addenda and methods known in the photographic art. That is, the emulsions can be sensitized to form latent images primarily on the surfaces of the silver halide grains. Noble metals, such as gold, middle chalcogens, such as sulfur, selenium and tellurium, and reduction sensitizers, can be employed individually or in combinations are examples of sensitizers that are contemplated. Typical chemical sensitizers are described in Research Disclosure, Item No. 308119, December 1989, published by Kenneth Mason Publications Ltd., Dudley Annes, 12a North Street, Emsworth, Hampshire PO 107DQ, England. This publication is referred to herein as "Research Disclosure".

The silver halide emulsions are spectrally sensitized with dyes from a variety of classes, including the polymethine dye class, which includes the cyanines, merocyanines, complex cyanines and merocyanines(i.e., tri-, tetra-, and poly-nuclear cyanines and merocyanines), oxonols, hemioxonols, stryrls, merostyryls, and streptocyanines. Combinations of spectral sensitizing dyes are also useful. Illustrative sensitizing dyes are disclosed in, for example, Research Disclosure Section IV.

The emulsion layers and other layers of the duplicating element can comprise vehicles and binders known in the photographic art, such as described in Research Disclosure Section IX and the references cited therein.

In addition to the couplers described herein the elements of the invention can include additional couplers as described in Research Disclosure Section VII and the publications cited therein. These added couplers can be incorporated as described in Research Disclosure Section VII and the publications cited therein. Added couplers can include, for example, DIR and DIAR couplers known in the photographic art to provide desired interimage effects. The described elements of the invention preferably do not include such DIR or DIAR couplers.

In either or both the high sensitive or medium sensitive green and red layers, the particle size of the coupler dispersion has a mean value of less than 0.14 micron, preferably a mean value within the range of about 0.01 to about 0.13 micron, as measured by Descrete Wavelength Turbidimetry (U.K. Patent 2,071,841B).

The coupler dispersions having the size limitations set forth in accordance with this invention can be prepared by the processes set forth in U.S. Pat. No. 4,933,270, European Patent Application 0,374,837 and in copending application Ser. Nos. 366,397, filed Jun. 15, 1989; 416,205, filed Oct. 2, 1989; 442,827, filed Nov. 29, 1989; 543,910, filed Jun. 26, 1990 and 440,160, filed Nov. 22, 1989, all of which are incorporated herein by reference.

Any cyan image-dye forming coupler, any magenta image-dye forming coupler and any yellow image-dye forming coupler that provide the desired color reproduction are useful in the described duplicating element. Combinations of such image-dye forming couplers are also useful. Preferably the duplicating element as described comprises in the red-sensitive layer a cyan image-dye forming coupler that is a phenolic or naphtholic cyan image-dye forming coupler; the green-sensitive layer comprises a magenta image-dye forming coupler that is a pyrazolone image-dye forming coupler in combination with a pyrazolotriazole magenta image-dye forming coupler; and the blue-sensitive layer comprises a pivaloylacetanilide or benzoylacetanilide yellow image-dye forming coupler.

Useful cyan image-dye forming couplers are described in, for example, such representative patents and publications as: U.S. Pat. Nos. 2,772,162; 2,895,826; 3,002,836; 3,034,892; 2,474,293; 2,423,730; 2,367,531; 3,041,236; and 4,333,999 and "Farbkuppler: Ein Literaturubersicht," published in Agfa Mitteilungen, Band III, pp. 156–175 (1961). The cyan image-dye forming couplers described in U.S. Pat. No. 4,333,999 are preferred.

Preferably such couplers are phenols and naphthols which form cyan dyes on reaction with oxidized color developing agent at the coupling position, i.e. the carbon atom in the 4-position of the phenol or naphthol. Structures of such preferred cyan coupler moieties are:

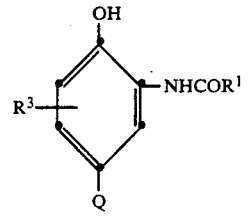

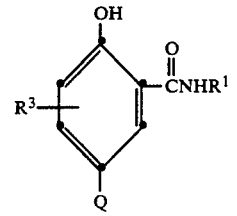

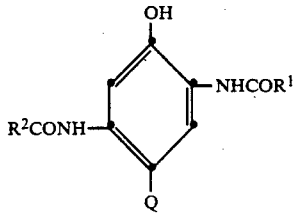

-continued

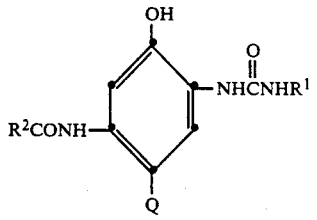

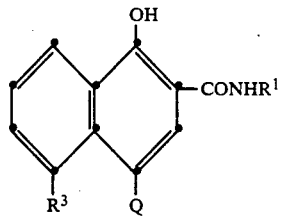

where $R^1$ and $R^2$ can represent a ballast group or a substituted or unsubstituted alkyl or aryl group, and $R^3$ represents one or more halogen (e.g., chloro, fluoro), alkyl having from 1 to 4 carbon atoms or alkoxy having from 1 to 4 carbon atoms. $R^4$ is hydrogen or a substituent that aids stabilization such as $NHCOOCH_2CH(CH_3)_2$. Q is hydrogen or a coupling-off group known in the photographic art.

Couplers which form magenta dyes upon reaction with oxidized color developing agent are described in such representative patents and publications as: U.S. Pat. Nos. 2,600,788; 2,369,489; 2,343,703; 2,311,082; 3,824,250; 3,615,501; 4,076,533; 3,152,896; 3,519,429; 4,062,653; 2,908,573; 4,540,654; European Patent Applications 285,274; 284,240 and 284,239; and "Farbkuppler: Eine Literature übersicht", published in Agga Mitteilungen, Band III, pp. 126–156 (1961).

Preferably such couplers are pyrazolones and pyrazolotriazoles which form magenta dyes upon reaction with oxidized color developing agents at the coupling position, i.e. the carbon atom in the 4-position for pyrazolones and the 7-position for pyrazolotriazoles. Structures of such preferred magenta coupler moieties are:

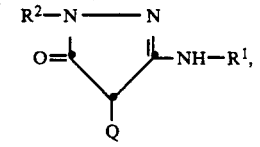

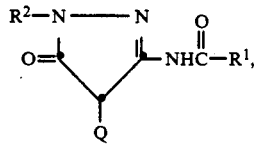

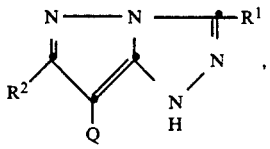

-continued

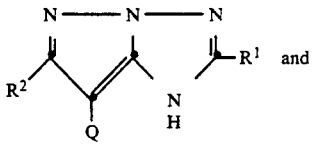

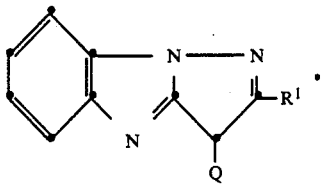

wherein $R^1$ and $R^2$ are as defined above; $R^2$ for pyrazolone structures is typically phenyl or substituted phenyl, such as for example 2,4,6-trihalophenyl, and for the pyrazolotriazole structures $R^2$ is typically alkyl or aryl. Q is as described.

Couplers which form yellow dyes upon reaction with oxidized color developing agent are described in such representative patents and publications as: U.S. Pat. Nos. 2,875,057; 2,407,210; 3,265,506; 2,298,443; 3,048,194; 3,447,928; and "Farbkuppler: Eine Literature übersicht," published in Agfa Mitteilungen, Band III, pp. 112–126 (1961).

Preferably such yellow dye-forming couplers are acylacetamides, such as benzoylacetanilides and pivaloylacetanilides. These couplers react with oxidized developer at the coupling position, i.e. the active methylene carbon atom. Structures of such preferred yellow coupler moieties are:

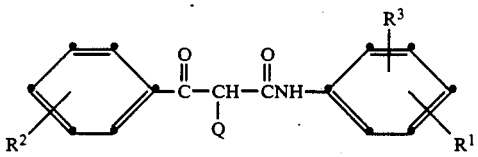

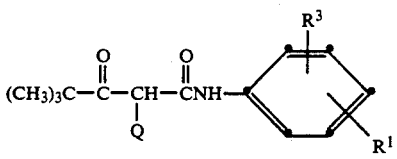

where $R^1$ and $R^2$ are as defined above and can also be hydrogen, alkoxy, alkoxycarbonyl, alkanesulfonyl, arenesulfonyl, aryloxycarbonyl, carbonamido, carbamoyl, sulfonamido, or sulfamoyl, $R^3$ is hydrogen or one or more halogen, lower alkyl (e.g. methyl, ethyl), lower alkoxy (e.g., methoxy, ethoxy), or a ballast (e.g. alkoxy of 16 to 20 carbon atoms) group.

A preferred duplicating element as described comprises a support, preferably a film support, bearing, in sequence:

(a) at least two red-sensitive photographic silver bromoiodide emulsion layer comprising a cyan image-dye forming coupler of the formula:

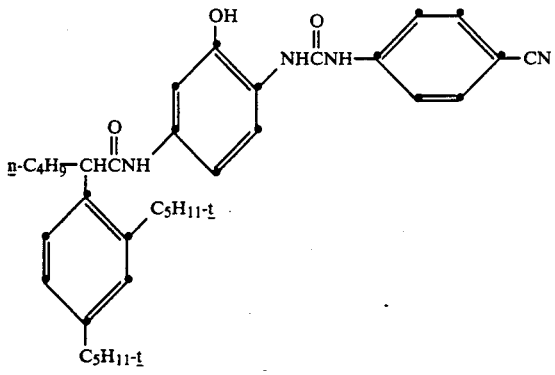

(b) at least two green-sensitive photographic silver bromoiodide emulsion layer comprising a combination of a major proportion of a magenta image-dye forming coupler of the formula:

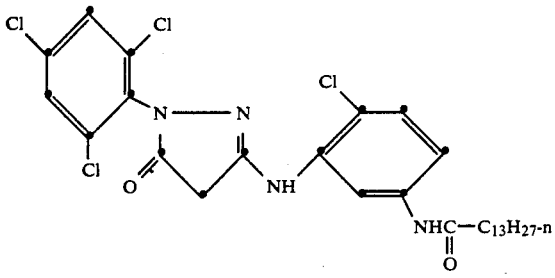

and a minor proportion of a magenta image-dye forming coupler of the formula:

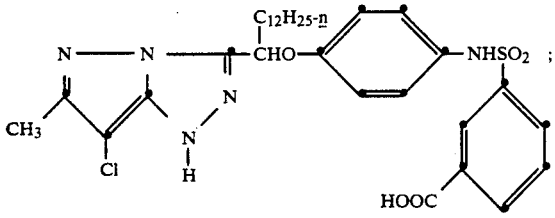

and (c) at least one blue-sensitive photographic silver bromoiodide emulsion layer comprising a yellow image-dye forming coupler of the formula:

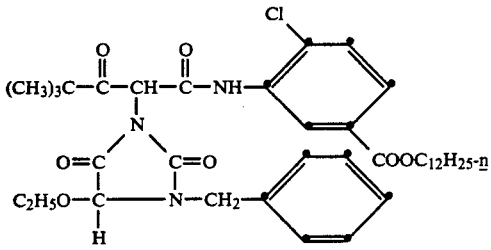

and a magenta colored masking coupler of the formula:

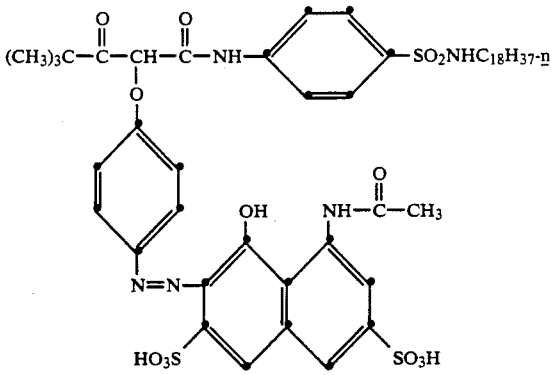

and a contaminating color coupler of the same formula as the cyan image-dye forming coupler.

The couplers and other components of the described duplicating element can be prepared by methods known in the organic synthesis art and the photographic art.

A preferred embodiment of the described duplicating element is one in which the green-sensitive photographic silver halide emulsion layer comprises a combination of a major proportion, that is more than 50% by weight of the total magenta couplers, of a pyrazolone magenta image-dye forming coupler and a minor proportion, that is less than 50% by weight of the total magenta couplers, of a pyrazolotriazole magenta image-dye forming coupler; and wherein the blue-sensitive photographic silver halide emulsion layer comprises an acetanlide yellow image-dye forming coupler, optionally contaminated with a phenolic image-dye forming coupler, and comprises a magenta colored masking coupler, preferably a magenta colored masking coupler as described herein.

Another requirement of a preferred embodiment of the invention, as set forth above, is that at least a higher red-sensitive and a higher green-sensitive layer is starved with respect to the amount of coupler present. By "high" is meant either the highest sensitive layer or the medium sensitive layer or both with respect to the low sensitive layer. That is, in these starved layers the coupler present is not sufficient to react with the oxidized developer formed during development after maximum exposure. For example in the high red-sensitive layer, all of the cyan image forming coupler will react with oxidized developer before the maximum cyan density is reached.

When these conditions are present in the high or medium sensitive layers of both the red and green composite layers and preferably in both the high sensitive and medium sensitive red and green composite layers the resulting granularity of the light sensitive element is greatly reduced.

While it is preferred that regarding the order of layers, the red-sensitive composite layer is closest to the support, the green-sensitive composite layer is intermediate the blue layer furthest from the support, and the red composite layer, the order of these layers on the support can be selected freely. All of the layers of the same spectral sensitivity need not be adjacent each other. For example, the position of layers set forth in U.S. Pat. No. 4,184,876, incorporated herein by reference, may be employed.

The photographic light-sensitive materials used in the present invention may have auxiliary layers such as a protective layer, intermediate layer, filter layer, antihalation layer and backing layer, in addition to the silver halide emulsion layers, when needed.

Gelatin is advantageously used as the binder or protective colloid to be incorporated into the emulsion layer or intermediate layer of the photographic light-sensitive materials of the present invention, and other hydrophilic colloids can, of course, be used.

For instance, proteins such as gelatin derivatives, graft polymers of gelatin and other high molecular weight substances, protein such as albumin, casein, etc.; cellulose derivatives such as hydroxyethyl cellulose, carboxymethyl cellulose, cellulose sulfates,.etc.; saccharide derivatives such as sodium alginate, starch derivatives, etc.; mono-co-copolymers and the like of various synthetic hydrophilic high molecular weight substances such as polyvinyl alcohol, partially acetalized polyvinyl alcohol, poly-N-vinylpyrrolidone, polyacrylic acid, polymethacrylic acid, polyacrylamide, polyvinyl imidazole, polyvinyl pyrazole, etc., can be used.

Gelatins which can be used in the present invention include lime-treated gelatin, acid-treated gelatin and enzyme-treated gelatin as described in *Bull. Soc. Sci. Pho. Japan*, No. 16, page 30 (1966); and in addition, hydrolyzed or enzyme-decomposed products of gelatins can also be used.

The photographic light-sensitive materials used in the present invention can further contain, in addition to the above-mentioned additives, various kinds of additives known to be useful in the photographic art, such as stabilizers, stain inhibitors, developing agents or precursors thereof, lubricants, mordants, matting agents, antistatic agents, plasticizers and other various kinds of additives which are useful for photographic light-sensitive materials. Typical examples of these additives are described in *Research Disclosure*, RD Nos. 17643 (December, 1978) and 18716 (November, 1979).

The duplicating element as described can be exposed as described in Research Disclosure paragraph XVIII.

The duplicating element can be processed by compositions and processes known in the photographic art for processing duplicating elements, especially processes and compositions known for preparation of duplicates of motion picture films. A typical example of a useful process is the ECN-2 process of Eastman Kodak Company, U.S.A. and the compositions used in such a process. Such a process and compositions for such a process are described in, for example, "Manual for Processing Eastman Color Film—H-24", available from Eastman Kodak Company, Rochester, N.Y., U.S.A. Processing to form a visible dye image includes the step of contacting the exposed element with a color developing agent to reduce developable silver halide and oxidized color developing agent. Oxidized developing agent in turn reacts with the couplers to yield dye.

Any color developing agent is useful for processing the described duplicating element. Preferred color developing agents are described in, for example, U.S. Pat. No. 4,892,805 in column 17, the disclosure of which is incorporated herein by reference.

A preferred process and the preferred processing compositions for a photographic element of the invention are those that are known to be useful in the photographic motion picture film art for processing motion picture duplicating films.

The following examples further illustrate the invention.

EXAMPLE 1

Color Photographic Element of the Invention

A cellulose acetate film support is coated with the following layers, in sequence (the coverages given are in milligrams per meter squared):

Layer 1—Slow Cyan (244 as Ag) red sensitized cubic grain silver bromoiodide (3.5% iodide) gelatin emulsion. 0.042 micron grain size and chemically sensitized with sulfur and gold sensitizers.
(353) cyan dye forming coupler C-1. mean particle size 0.12 microns
(59) masking coupler MC-1.
(167) cyan absorber dyes
(3174) gelatin vehicle.

Layer 2—Mid Cyan (154 of Ag) red sensitized cubic grain silver bromoiodide (3.5% iodide) gelatin emulsion. 0.072 micron grain size chemically sensitized with sulfur and gold sensitizers.
(169) cyan image-dye forming coupler C-1. mean particle size 0.12 microns
(51) masking coupler MC-1.
(646) gelatin vehicle.

Layer 3—Fast Cyan (202 as Ag) 50% by weight red sensitized cubic grain silver bromoiodide (3.5% iodide) emulsion (0.136 micron grain size chemically sensitized with sulfur and gold sensitizers) with 50% by weight red sensitized cubic grain silver bromoiodide (3.5% iodide) emulsion (0.091 micron grain size chemically sensitized with sulfur and gold sensitizers).
(98) cyan image-dye forming coupler C-1. mean particle size 0.12 microns
(4.3) masking coupler MC-1
(780) gelatin vehicle.

Layer 4—Interlayer (699) gelatin vehicle
(269) IDH-1

Layer 5—Slow Magenta (377 as Ag) green sensitized cubic grain silver bromoiodide (3.5% iodide) gelatin emulsion. 0.056 micron grain size chemically sensitized with sulfur and gold chemical sensitizers.
(323) magenta image-dye forming coupler M-1. mean particle size 0.10 microns
(85) masking coupler MC-2.
(100) magenta absorber dye.
(263) gelating vehicle.

Layer 6—Mid Magenta (155 as Ag) Green sensitized cubic grain silver bromoiodide (3.5% iodide) emulsion. 0.080 micron grain size chemically sensitized with sulfur and gold chemical sensitizers.
(107) magenta image-dye forming coupler M-1. mean particle size 0.10 microns
(53) masking coupler MC-2.
(807) gelatin vehicle.

Layer 7—Fast Magenta (194 as Ag) Green sensitized cubic grain silver bromoiodide (3.5% iodide) emulsion. 0.115 micron grain size chemically sensitized with sulfur and gold chemical sensitizers.
(27) magenta image-dye forming coupler M-1. mean particle size 0.10 microns
(54) magenta image dye forming coupler M-2. mean particle size 0.02 microns
(13) masking coupler MC-2.
(753) gelatin vehicle.

Layer 8—Interlayer (699) gelatin vehicle.
(209) IDH-1
(81) yellow filter dye.

Layer 9—Slow Yellow (111) blue sensitized cubic grain silver bromoiodide (3.5% iodide) emulsion. 0.115 grain size chemically sensitized with sulfur and gold chemical sensitizers and containing red spectral sensitizer.
(818) yellow image-dye forming coupler Y-1. mean particle size 0.13 microns
(23) magenta color masking coupler M-3.
(699) gelatin vehicle.

Layer 10—Mid Yellow (151) Blue sensitized cubic grain silver bromoiodide (3.5% iodide) emulsion. 0.145 micron grain size chemically sensitized with sulfur and gold chemical sensitizers and containing red spectral sensitizer.
(195) yellow image-dye forming coupler Y-1. mean particle size 0.13 microns
(9) magenta colored masking coupler MC-3.
(699) gelatin vehicle.

Layer 11—Fast Yellow (247) Blue sensitized cubic grain silver bromoiodide (3.5% iodide) emulsion. 0.197 micron grain size chemically sensitized with sulfur and gold chemical sensitizers and containing red spectral sensitizer.
(199) yellow image-dye forming coupler Y-1. mean particle size 0.13 microns
(12) magneta colored masking coupler MC-3.
(753) gelatin vehicle.

Layer 12—Blue Interlayer (915) gelatin vehicle.
(108) Lippmann silver.

Layer 13—Overcoat Layer (753) gelatin and matting agent.

The Y-1, MC-1, C-1, IDH-1, M-1, MC-2, M-2, and MC-3 are identified as follows:

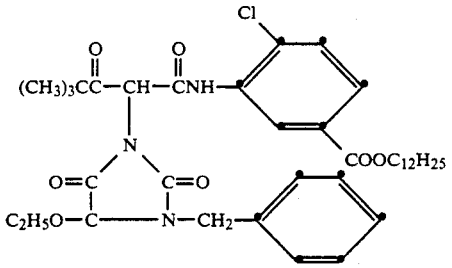

Y-1

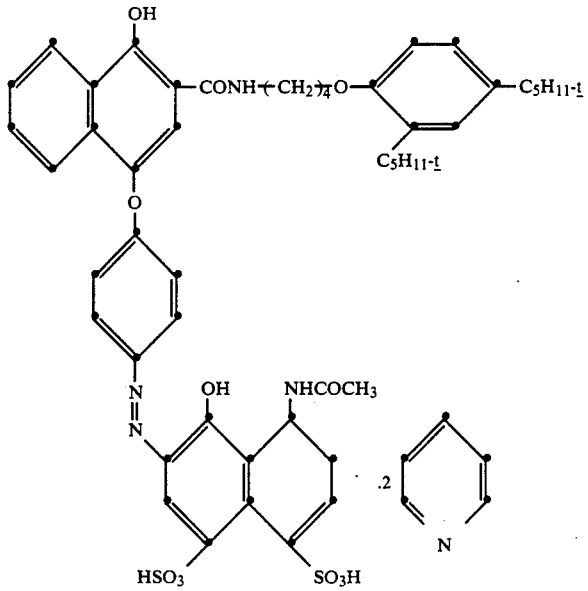

MC-1

-continued
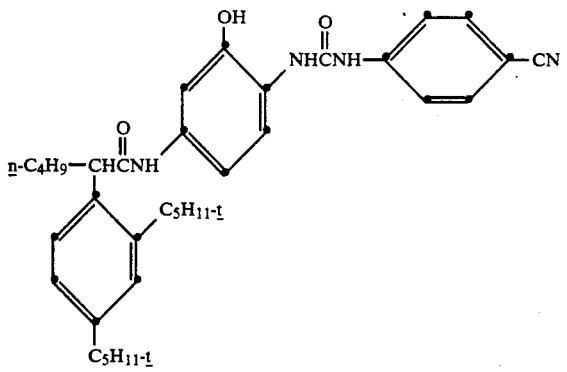
C-1
didodecylhydroquinone
IDH-1
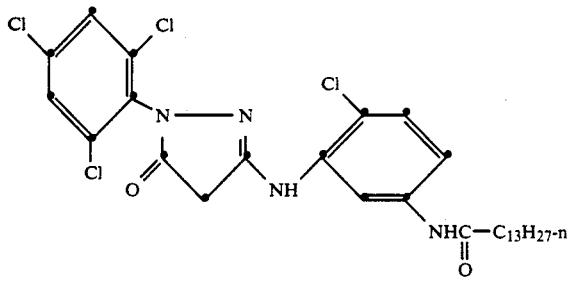
M-1
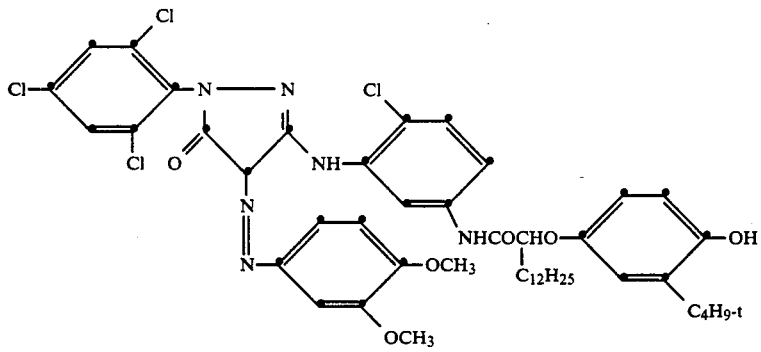
MC-2
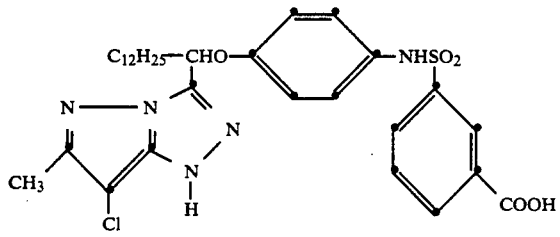
M-2

-continued

MC-3

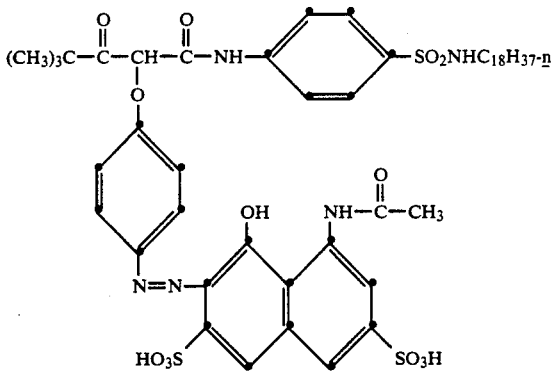

The described duplicating film of the invention was used in forming a color image as follows:

An original camera negative motion picture film (ON-1) (original color negative motion picture film) which was EI 100 35 mm EXR Color Negative Film No. 5248, (Trademark of and commercially available from Eastman Kodak Co., U.S.A.) was imagewise exposed to a conventional Macbeth Color Rendition Chart containing colors of the visible spectrum. The Macbeth Color Rendition Chart is commercially available from Macbeth, a division of Kollmorgen Corporation, 2441 N. Calbert St., Baltimore, Md., U.S.A. and is a trademark of Kollmorgan Corporation, U.S.A. The exposure provided a developable latent image in the ON-1 film. The exposed ON-1 film was then processed in a commercial Eastman Color Negative-2 process (ECN-2 process commercially available from Eastman Kodak Co., U.S.A.). This ECN-2 process and the compositions for this process are described in, for example, "Manual for Processing Eastman Color Film-H-24" available from Eastman Kodak Co, Rochester, N.Y., U.S.A.

The described intermediate duplicating film of the invention (IF-1) was then imagewise exposed to light using the described processed original color negative film (ON-1). A latent image was formed in the intermediate duplicating film based on the original color negative film. The imagewise exposed intermediate film was then processed in the same way using the same process (ECN-2) as described for the original color negative film.

The resulting processed intermediate film (IF-1) was then used to form a master positive film (MP-1) image. This master positive film was then again printed onto a second sample of the intermediate duplicating film of the invention (IF-2) as described above to provide a duplicate negative. The exposure steps and processing were essentially the same in each step as described for the exposure and processing of the original color negative film (ON-1).

Finally the duplicate negative (IF-2) (intermediate duplicating film of the invention) was printed onto Eastman Color Print Film (ECP-1) (commercially available from Eastman Kodak Co, U.S.A.) forming a release print. The exposure and processing of the Eastman Color Print film (ECP-1) was as commercially used for the ECP-2B process commercially available from Eastman Kodak Co. (The ECP-2B process and compositions for this process are as described in the above "Manual for Processing Eastman Color Films-H-24" available from Eastman Kodak Co., U.S.A.)

A developed color image was formed in the described films. The granularity of the intermediate duplicating film of the invention as described was visibly finer than than comparable films where any one or more of the essential requirements set forth previously were not followed.

EXAMPLE 2

Two different photographic silver bromoiodide emulsions were prepared. The first emulsion (1E) was a coarse grain tabular emulsion measuring 3.13 micron in diameter and 0.14 micron thick (1.08 cubic micron mean grain volume). The second emulsion (2E) was a fine grain cubic emulsion measuring 0.115 micron on edge (0.0015 cubic micron mean grain volune).

Two different dispersions (MD-1 and MD-2) were prepared containing magenta dye-forming coupler (MC) which was 1-(2,4,6-trichlorophenyl)-3-(5-tridecamide-2-chloroanil ino)-5-pyrazolone. In both dispersions coupler MC was dissolved in mixed tricresyl phosphate and this solution was dispersed in gelatin. Dispersion MD-1 was a coarse particle dispersion with a mean particle size of about 0.17 micron. Dispersion MD-2 was a fine particle dispersion with a mean particle size of about 0.10 micron.

Four photographic films were prepared in the same way except for the differences in the dispersions and emulsions as specified in following Table I. All the coatings were coupler starved with the concentrations of coupler MC at 0.108 g/m$^2$. The concentrations of emulsion silver were typical levels for each emulsion for a fast layer in a color photographic film. For the coarse grain emulsion, the silver was 1.34 g/m$^2$. for the fine grain emulsion, the silver was 0.215 g/m$^2$. In each layer the gelatin was 1.34 g/m$^2$. Each photographic film contained an overcoat layer containing 1.08 g/m$^2$ of gelatin and 0.00131 g/m$^2$ of 1,1-[oxybis(methylenesulfonyl)]bis-ethene as a hardener.

The four photographic films were exposed and processed through the ECN-2 process as described. RMS granularity was measured using a standard procedure and a 48 micron aperture. The maximum RMS granularity and the granularity at maximum density were measured for each of the films. The results are given in following Table II for each of the films.

TABLE I

| | Emulsion Laydown[a] | | Coupler A Laydown[a] Dispersion | |
|---|---|---|---|---|
| Coating | Coarse | Fine | A | B |
| A (comparison) | 1.34 | — | 0.108 | — |

TABLE I-continued

| Coating | Emulsion Laydown[a] Coarse | Emulsion Laydown[a] Fine | Coupler A Laydown[a] Dispersion A | Coupler A Laydown[a] Dispersion B |
|---|---|---|---|---|
| B (comparison) | 1.34 | — | — | 0.108 |
| C (comparison) | — | 0.215 | 0.108 | — |
| D (invention) | — | 0.215 | — | 0.108 |

[a]g/m²

TABLE II

| Coating | Emulsion | Dispersion | $\sigma \times 1000$ $\sigma_{MAX}$ | $\sigma_{D\text{-}MAX}$ | % Chg |
|---|---|---|---|---|---|
| A (comparison) | coarse | coarse | 21.6 | 1.98 | 9.2 |
| B (comparison) | coarse | fine | 20.6 | 1.41 | 6.8 |
| C (comparison) | fine | coarse | 2.16 | 1.46 | 68. |
| D (invention) | fine | fine | 2.22 | 0.78 | 35. |

Reduction of granularity by coupler starvation can be quantified by comparing the maximum granularity for a coating to the granularity at maximum density, the latter being smaller than the former. The greater the difference between these granularities, the more effective is the coupler starvation. Table II shows that for comparative coatings A and B with a coarse-grained emulsion, effective coupler starvation is attained regardless of what dispersion is used. In coating C with a fine-grained emulsion and a coarse particle dispersion, poor coupler starvation results. This situation is improved in coating D by the use of a fine particle dispersion, which demonstrates the invention claimed herein.

The invention has been described in detail with particular reference to preferred embodiments thereof, but it will be understood that variations and modifications can be effected within the spirit and scope of the invention.

What is claimed is:

1. A color photographic silver halide negative working duplicating element comprising a support having thereon at least one red-sensitive photographic silver halide emulsion layer comprising at least one cyan image-dye forming coupler; at least one green-sensitive photographic silver halide emulsion layer comprising at least one magenta image-dye forming coupler and at least one blue-sensitive photographic silver halide emulsion layer comprising at least one yellow image-dye forming coupler, wherein (a) at least one of the red-sensitive, green-sensitive or blue sensitive photographic silver halide emulsion layers comprises a unit of at least two layers including a first layer and a second layer, the first layer of each unit having a higher sensitivity than the second layer and being farther from the support than the second layer;

(b) the first layer contains an amount of image-dye forming coupler or couplers insufficient to react with all the oxidized developer formed during development after maximum exposure;

(c) the image-dye forming couplers of the first layer being in a dispersion having a mean particle size of less than 0.14 micron, and;

(d) the silver halide grains of the first layer having a mean grain volume less than 0.015 cubic micron.

2. The color photographic silver halide element of claim 1 wherein the silver halide grains of said first layers have a mean grain volume of from about 0.001 to about 0.015 cubic micron.

3. The color photographic silver halide element of claim 1 wherein the image-dye forming couplers of said first layers have a mean particle size of from about 0.01 to about 0.13 micron.

4. The color photographic silver halide element of claim 1 wherein the amount of image-dye forming coupler in the first layer is less than that sufficient to generate a dye density of less than 0.6.

5. The color photographic silver halide element of claim 1 wherein the red-sensitive photographic silver halide emulsion layer is a unit of at least three layers.

6. The color photographic silver halide element of claim 1 wherein the green-sensitive photographic silver halide emulsion layer is a unit of at least three layers.

7. The color photographic silver halide element of claim 1 wherein the blue-sensitive photographic silver halide emulsion layer is a unit of at least three layers.

8. The color photographic silver halide element of claim 5 wherein at least one of the layers of the unit except the layer closest to the support contains a cyan image-dye forming coupler in a dispersion having a mean particle size of less than 0.14 micron and present in an amount sufficient to generate a dye density of less than 0.6.

* * * * *